US006616508B1

(12) United States Patent
Kamamura et al.

(10) Patent No.: US 6,616,508 B1
(45) Date of Patent: Sep. 9, 2003

(54) INTERNAL GRINDING METHOD AND INTERNAL GRINDING MACHINE

(75) Inventors: Yuko Kamamura, Kanagawa (JP); Masanori Takahashi, Kanagawa (JP); Hiroki Mizuno, Kanagawa (JP)

(73) Assignee: NSK Ltd., Tokyo (JP)

( * ) Notice: Subject to any disclaimer, the term of this patent is extended or adjusted under 35 U.S.C. 154(b) by 0 days.

(21) Appl. No.: 09/517,451

(22) Filed: Mar. 2, 2000

(30) Foreign Application Priority Data

Mar. 2, 1999 (JP) ..... 11-054845

(51) Int. Cl.[7] ..... B24B 5/10; B24B 49/16
(52) U.S. Cl. ..... 451/8; 451/21; 451/51
(58) Field of Search ..... 451/8, 10, 27, 451/21, 22, 51, 52; 125/11.15, 11.18

(56) References Cited

U.S. PATENT DOCUMENTS 3,774,349 A * 11/1973 Uhtenwoldt et al. ..... 451/27
4,845,895 A * 7/1989 Kihara et al. ..... 451/27
5,384,983 A * 1/1995 Siggelin ..... 451/65

FOREIGN PATENT DOCUMENTS

| | | | |
|---|---|---|---|
| JP | 53-14797 | 5/1978 | ..... B23Q/15/00 |
| JP | 4-310368 | 11/1992 | ..... B24B/49/04 |
| JP | 5-285808 | 11/1993 | ..... B24B/5/06 |

* cited by examiner

*Primary Examiner*—Robert A. Rose
(74) *Attorney, Agent, or Firm*—Sughrue Mion, PLLC

(57) ABSTRACT

An internal grinding method for grinding an inner surface of a work having a straight line generatrix shape while performing an in-process inner-diameter size measurement intermittently through oscillation synchronized between a grindstone and a measurer; wherein a circumferential surface of the grindstone is trued into a shape inclined with respect to a moving direction of a X-axis slide table moving forward/backward relative to the work so that normal grinding force when the X-axis slide table moves backward is reduced, while the work is supported with inclination with respect to the moving direction of the X-axis slide table so that the X-axis slide table is oscillated in the moving direction.

12 Claims, 6 Drawing Sheets

INTERNAL GRINDING METHOD AND INTERNAL GRINDING MACHINE

BACKGROUND OF THE INVENTION

1. Field of the Invention

The present invention relates to an internal grinding method for grinding an inner surface of a work having a straight-line generatrix shape while oscillating a grindstone relative to the work, and an internal grinding machine useful in carrying out this method.

2. Description of the Related Art

Internal grinding of a cylindrical small part such as a rolling bearing inner ring is performed by moving (oscillating) a grindstone forward and backward within a work along an axis of a X-axis slide table while carrying out intermittent in-process measurement. When an inner surface of a small work 2 is ground, a dimensional restriction does not allow a grindstone 1 attached at an end of a wheel spindle 4 and an in-process gauge 3 to keep simultaneous contact with a ground surface of the work 2. As shown in FIGS. 6 and 7, the grindstone 1 and the in-process gauge 3 are therefore oscillated synchronizedly so as to perform size measurement on the work 2 by inserting the in-process gauge 3 into the work 2 when the grindstone 1 moves backward.

By this method, conventionally, grinding is generally finished when intermittently measured value reaches over a predetermined target-size value. In this case, however, the grinding cannot be always finished at a real target size. Accordingly, the dimensional accuracy is restricted. With regard to this aspect, in order to improve the dimensional accuracy, there have been proposed a method and a device in which predictive control is performed. On the basis of the intermittently measured in-process signal, the measuring device is retreated and the feeding of a grindstone is stopped on the basis of the predictive control signal (Japanese Patent Examined Publication No. Sho. 53-14797). In this method, the measuring device retreats just before the target size and terminates its size measuring operation. The grindstone is retreated from the work when the predicted size gets the target-size.

In the above-mentioned method and device, grinding is finished (the grindstone is retreated, from the work) at an arbitrary position in an oscillation stroke in accordance with the predictive target size signal. As a result, the contact position between the work and the grindstone is not fixed when grinding is terminated, which causes difference in diameter in the inner surface of the work. For such a reason, there is a disadvantage that the generatrix shape of the work deteriorates.

In order to solve the foregoing problem, there has been proposed a method in which an predictive operation for the work size is carried out with intermittently measured data by an intermittent in-process measuring device, and the oscillation speed or the remaining number of oscillation after the predictive operation is controlled so that a grindstone comes to a forward end of its oscillation just when the work size comes into a certain range of its target size (Japanese Patent Unexamined Publication No. Hei. 4-310368). In this method, a grindstone always stops grinding in full contact in axial direction, so that not only the dimensional accuracy of the work but also the generatrix shape accuracy and the cylindrical accuracy are improved.

In actual grinding work, the wheel spindle 4 is bent by normal grinding force as shown in FIGS. 8 and 9. As a result, when the oscillation of the grindstone 1 is backward, the forward end of the grindstone 1 grinds the surface of the work 2 locally. Specifically, in the above-mentioned grinding method accompanied with intermittent measurement, grinding width Wb becomes about ½ of whole length Wf of the work when the grindstone moves backward, as shown in FIG. 8. In the conventional method, however, the wheel spindle 4 is oscillated in parallel with the moving direction of the X-axis slide table which performs trueing of the grindstone, so that the normal grinding force is not reduced in proportion to the reduction of the grinding width (Wf→Wb) when the grindstone moves backward. As a result, the normal grinding force per unit grinding width becomes excessive so that the grindstone 1 machines the work 2 at its forward edge 1*a* sharply. When the generatrix shape of the work deteriorates on a large scale in the process of grinding, the deterioration affects the dimensional accuracy of the work when the grinding is terminated. It is therefore necessary to keep the generatrix shape of the work properly during machining.

The above-mentioned conventional methods are not intended to improve the work shape on the way of grinding, but to correct the work generatrix shape, which has deteriorated in the machining cycle, just before finishing gringing, without lowering the dimensional accuracy. For example, in the foregoing grinding control method in Japanese Patent Unexamined Publication No. Hei. 4-310368, the grindstone always stop grinding at a forward end of an oscillation stroke, but deterioration of the generatrix shape of a work caused by sharp grinding at the forward end of the grindstone during its oscillating operation cannot be removed completely when grinding is terminated. In addition to the deterioration of the work shape, in the conventional methods, there is a problem of local abrasion of the grindstone due to large grinding resistance produced locally when the grindstone moves backward, so that the life of the grindstone is shortened.

Therefore, the applicant of the present invention has therefore disclosed a grindstone oscillation method in which a grindstone was oscillated in a direction inclined relative to the forward/backward moving direction of a X-axis slide table which performs trueing of the grindstone. In order to realize this method, the applicant developed an internal grinding machine shown in FIG. 10 (Japanese Patent Unexamined Publication No. Hei. 5-285808). This configuration will be described with reference to FIGS. 10 and 11.

An X-axis slide table 7 and a work head-stock (not shown) which holds a work 2 in opposition to the moving direction of the table 7 are mounted on a bed of a grinding machine. Further, an in-process measuring device 9 having an in-process gauge 3 is provided in the vicinity of the head-stock. An oscillation unit 6 is mounted on the X-axis slide table 7 through a vertical pivot shaft 115 which can be inclined relative to the table 7. In addition, a table 116 which reciprocates along a guide portion 6*a* is mounted on the oscillation unit 6. A wheel spindle device 5 which can be inclined relative to the table 116 is mounted on the table 116. In the illustrated example, the wheel spindle device 5 which can be moved around a pivot 114 (see FIG. 10) provided on the working table 116, which is independent of the motion of the oscillation unit 6 relative to the X-axis slide table 7. In this connection, this pivotal structure may be replaced so that arcuate irregular engagement portions each having an appropriate radius around the pivot shaft 115 of the oscillation unit 6 is formed on the upper surface of the table 116 and the lower surface of the wheel spindle device 5 respectively, and the wheel spindle device 5 can be tilted relative to the working table 116 along these arcuate engagement portions. Four piezoelectric force transducer 117 for detecting normal grinding force are mounted between the wheel spindle device 5 and the table 116. The normal grinding force applied to the grindstone 1 in grinding operation is sum of the values detected by the four force transducers 117.

An arcuate groove 118 with the pivot shaft 115 as a center thereof is formed in the upper surface of a rear end of the oscillation unit 6. Through this arcuate groove 118, a clamp bolt 119 for fixing the oscillation unit is screwed into the X-axis slide table 7 from the upper surface of the oscillation unit 6. A hydraulic cylinder (not shown) is mounted on the X-axis slide table 7. A piston rod 120 of the hydraulic cylinder is engaged with a head portion of the clamp bolt 119. The clamp bolt 119 is rotated by the forward/backward movement of the piston rod 120 so that the oscillation unit 6 is fastened or unfastened to the X-axis slide table 7 by the bolt head portion to be thereby automatically clamped or released from clamping. Though not illustrated, the wheel spindle device 5 can be also tilted and then clamped onto the working table 116 by a suitable clamping device.

The oscillation unit 6 has a motor, a linear guide and an eccentric cam. By driving the motor, through the eccentric-cam and the linear guide, the oscillation unit 6 gives table 116 located above sine-wave reciprocating motion. (oscillating operation) along the guide 6*a*. The oscillation unit 6 is inclined at an angle θ with respect to the moving direction of the X-axis slide table 7. This angle is regarded as an oscillation angle. When an initial oscillation angle θ is decided, grinding is firstly performed with the oscillation angle θ=0. The normal grinding force is detected by the force transducers 117, and the angle θ is calculated in an arithmetic circuit 121 (See the expression (14) in the embodiment according to the present invention.) Then, the clamping device for the oscillation unit 6 is released, and the oscillation unit 6 is rotated by the angle θ around the pivot shaft 115 by a linear motor 113 through a motor driving device 122 on the basis of an output signal from the arithmetic circuit 121. Next, the oscillation unit 6 is fixed onto the X-axis slide table 7 by the foregoing clamping device for the grindstone oscillation unit. At the same time, the wheel spindle device 5 is rotated reversely by the same angle θ relative to the working table 116 so as to be clamped. As a result, a grindstone generatrix is kept parallel to the moving direction of the X-axis slide table 7. Then, the X-axis slide table 7 is moved forward so that the grindstone 1 at the left side of the wheel spindle device 5 is inserted into the work 2. A motor (not shown) on the bed gives feed motion to start oscillation grinding of the work 2. The direction of the oscillation is inclined at the angle θ with respect to the grindstone generatrix without load.

Trueing of the grindstone 1 is performed in the forward/backward motion of the X-axis slide table 7 by a truer 8 provided in parallel with the moving direction of the X-axis slide table 7.

In the above-mentioned grindstone oscillation method in internal grinding and the internal grinding machine therefor disclosed in Japanese Patent Unexamined Publication No. Hei. 5-285808, a grindstone is moved backward at the oscillation angle θ inclined relative to the X-axis in a direction that the grindstone moves away from the work. As a result, the bending quantity of the wheel spindle is reduced when the grindstone moves backward, and the normal grinding force per unit grinding width is lowered. Accordingly, if the above-mentioned oscillation angle is selected suitably, the normal grinding force per unit grinding width can be made equal between two cases when the grindstone moves most backward and forward. Thus, sharp grinding is prevented in the position where the grindstone moves backward so that internal grinding without any difference in level on the ground surface of the work can be attained as shown in FIG. 12A in comparison with the internal grinding shown in FIG. 12B to which this method is not applied. The method is extremely useful in this term. However, the method provides a configuration in which the wheel spindle is oscillated in a direction inclined relative to the moving direction (axial direction of the grindstone) of the X-axis slide table which performs trueing of the grindstone. As a result, an oscillation unit 6 having a table 116 supported on the X-axis slide table 7 so as to perform an oscillating operation is required in addition to the X-axis slide table 7. Thus, there has been a problem that mechanisms are increased in number and in complexity so that the grinding machine as a whole becomes expensive.

SUMMARY OF THE INVENTION

The object of the present invention is to provide an internal grinding method and an internal grinding machine which does not need to provide the oscillation unit, and the slide table on it and so on in the invention (Japanese Patent Unexamined Publication No. Hei. 5-285808); in which, with a simple structure with low cost, normal grinding force per unit grinding width can be prevented from being excessive when a grindstone moves backward; and in which the shape of a work can be improved and the life of the grindstone can be long.

The present invention provides an internal grinding method for grinding an inner surface of a work having a straight line generatrix shape while performing an in-process inner-diameter size measurement intermittently through high-speed oscillation synchronized between a grindstone and an in-process gauge; wherein a circumferential surface of the grindstone is trued into a shape inclined with respect to a moving direction of a X-axis slide table moving forward/backward relative to the work so that normal grinding force when the X-axis slide table moves backward is reduced, while the work is supported with inclination with respect to the moving direction of the X-axis slide table so that the X-axis slide table is oscillated in the moving direction. Further, the present invention provides an internal grinding machine comprising: an X-axis slide table for performing an oscillating operation along an axis of a grindstone; a wheel spindle device having the grindstone at its end, the grindstone having a circumferential surface with a tapered shape; a cross slide table for moving in a direction perpendicular to the direction of the X-axis; a grindstone trueing device held on the cross slide table and for traverse trueing the circumferential surface of the grindstone; a work supporting device held on the cross slide table and for supporting a work inclined relative to the X-axis so that an inner surface of the work contacts with the circumferential surface of the grindstone; an in-process size measuring device held on the work supporting device inclined together with the work; and a control device for controlling forward/backward motion of the X-axis slide table and feed motion of the cross slide table so that the circumferential surface of the grindstone is trued with tapered shape.

Trueing of a grindstone is performed by relative movement between a X-axis slide table and a truer. According to the present invention, trueing is carried out as the surface of the grindstone is inclined in a tapered state relative to the oscillation direction based on the X-axis slide table. Thus, the grindstone moves backward in a direction to separate from a work when the grindstone moves backward. In addition, the work, if it needs cylindricity, is supported in advance so as to be inclined in a direction to provide proper cylindricity when the bending of the X-axis at the time of grinding is applied in the direction of the grindstone surface trued in inclination. As a result, the bending quantity of a wheel spindle is reduced when the grindstone moves backward, so that normal grinding force per unit grinding width is lowered. Thus, if the trueing angle of the grindstone is selected suitably, the normal grinding force per unit grinding width when the grindstone moves most backward becomes smaller than that in the related art.

DETAILED DESCRIPTION OF THE PREFERRED EMBODIMENTS

Figures 1A, 1B:
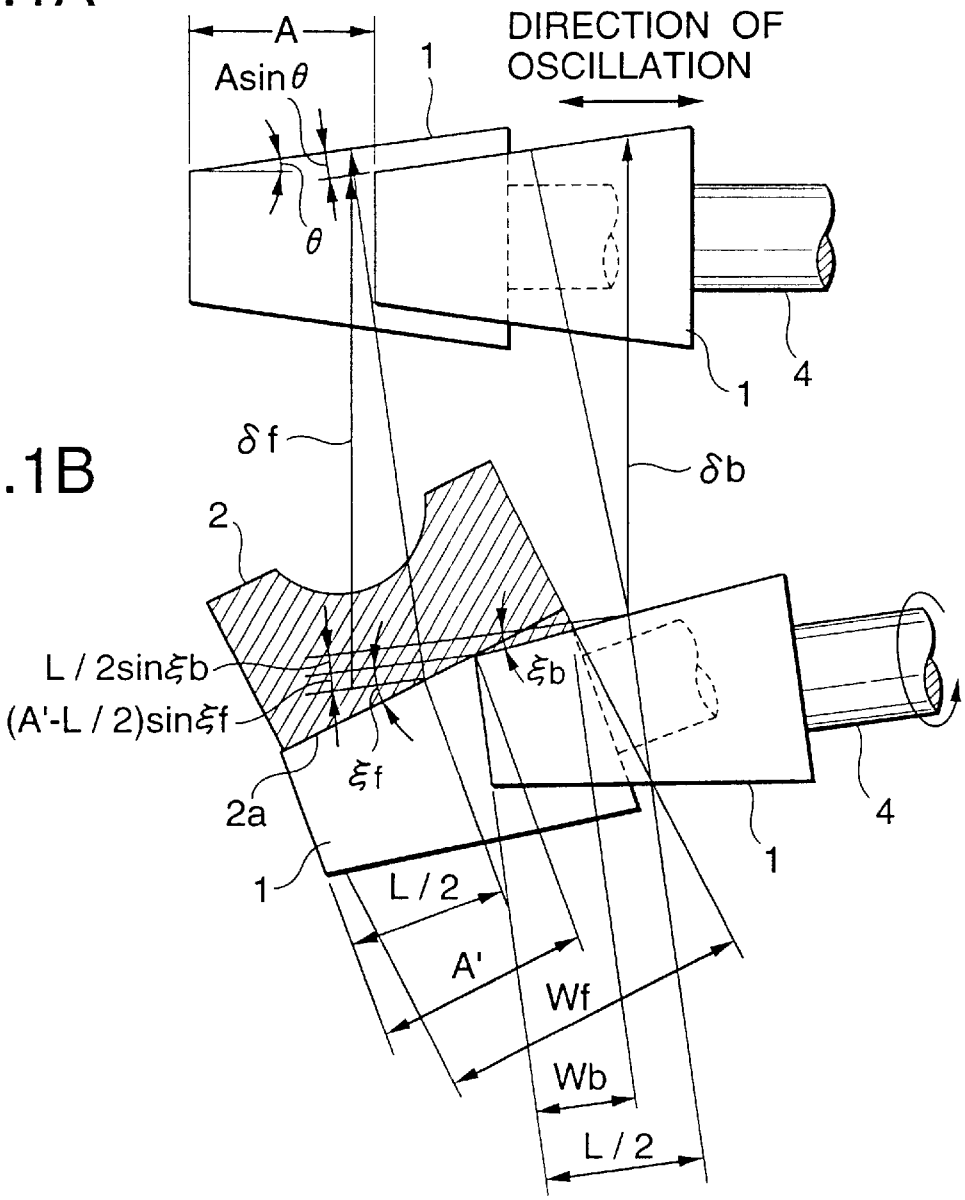
FIGS. 1A and 1B are views showing, in enlargement, a positional relationship between a work and a grindstone for explaining selection of a trueing angle θ according to the present invention.

A description will be given of an embodiment of the present invention with reference to the drawings. FIGS. 1A and 1B show, in enlargement, a positional relationship between a work 2 and a grindstone 1 for explaining selection of a trueing angle θ according to the present invention. FIG. 1A is a longitudinally sectional view showing an oscillating operation state of the grindstone 1 with no load. FIG. 1B is a longitudinally sectional view showing an oscillating operation state of the work and the grindstone with a load at the time of machining. According to the present invention, the shape of the circumferential surface of the grindstone provided at the end of a wheel spindle device is inclined relative to the X-axis in the direction (at an angle θ with the X-axis) so that bending of a wheel spindle 4 is released and reduced when the grindstone moves backward. Bending quantity $\delta_b$ of the wheel spindle when the grindstone moves backward depends on the released quantity of bending produced by a difference in angle between a work surface 2*a* where normal grinding force is applied so as to be inclined and the newly-set inclined circumferential surface of the wheel spindle. Then, the normal grinding force per unit grinding width when the grindstone moves backward can be adjusted on the basis of the value of the above-mentioned trueing angle θ. This angle θ can be expressed by a function using, as a variable, the normal grinding force when the grindstone moves most forward, on the basis of a numerical expression model which will be described later.

Assuming as follows to analyze the trueing angle θ according to the present invention;

(a) To perform grinding upon a work having no difference of diameter on its inner surface for the sake of simplification.

(b) To regard the quantity with which the work is ground while the grindstone moves from its forward position to its backward position as much smaller than the bending quantity of the wheel spindle at the time of working.

(c) To take up a moment immediately before the grindstone grinds the work, obtain normal grinding force from the bending quantity of the wheel spindle at this moment, and analyze how the grindstone grinds the work.

(d) For the grindstone surface and the ground surface to produce no elastic deformation due to grinding force, that is, for a tangent touching the grindstone and the work to be always expressed by a straight line.

The symbols shown in FIGS. 1A and 1B are as follows.

A: grindstone oscillation stroke;

A': grindstone moving distance parallel with the grindstone surface at the time of grindstone oscillation;

$F_f$, $F_b$: normal grinding force;

L: axial length of grindstone;

$W_f$, $W_b$: grinding width;

$\delta_f$, $\delta_b$: bending quantity of central portion of grindstone surface;

$\xi_f$, $\xi_b$: inclination angle of grindstone surface caused by normal force; and θ: trueing angle (angle of generatrix of grindstone circumferential surface with respect to the grindstone axis).

Here, the suffixes f and b designate those when the grindstone moves forward (f) and backward (b) respectively. In addition, mechanical bending rigidity $K_m$ in the normal direction and grindstone surface inclination sensitivity $S_c$ of the grindstone surface with respect to the normal grinding force are defined as follows.

$$K_m=2F/(\delta_1+\delta_2)$$

$$S_c=(\delta_1-\delta_2)/F\cdot B$$

Figure 2:
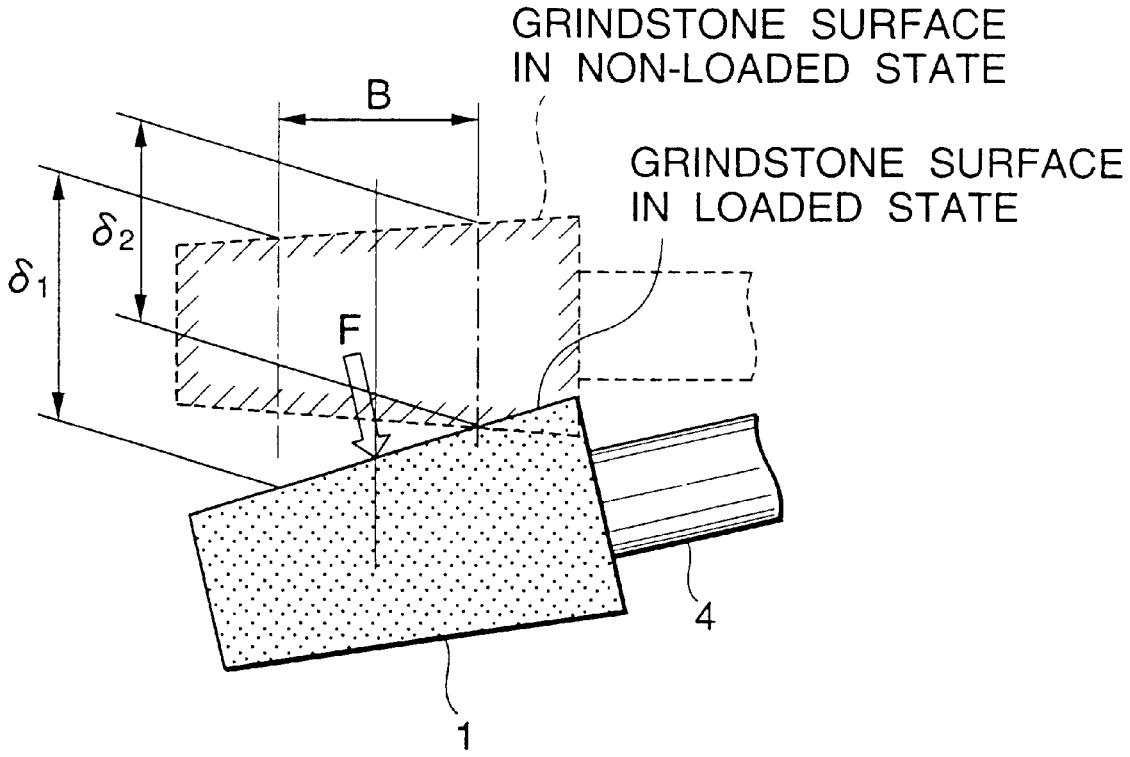
FIG. 2 is a model view showing a bending state of a wheel spindle during grinding.

In FIG. 2, the quill 4 receives normal-direction force in a central part of the grindstone surface so as to bend. Normal force F and displacement quantities $\delta_1$ and $\delta_2$ in the normal-force direction at two points (width B) which are symmetrical with respect to the central part of the grindstone surface are measured.

In FIG. 1, firstly, the bending quantity of the wheel spindle changes in the condition that the trueing angle is represented by θ. From the geometric dimensional relationship in FIGS. 1A and 1B:

$$A \sin\theta=(\delta_f-\delta_b)-\{(A'-L/2)\sin\xi_f+(L/2)\sin\xi_b\} \quad (1)$$

Angles of the grindstone surface inclined due to the normal grinding force are expressed as:

$$\tan\xi_f=S_c\cdot F_f=S_c\cdot K_m\cdot\xi_f \quad (2)$$

$$\tan\xi_b=S_c\cdot F_b=S_c\cdot K_m\cdot\xi_b \quad (3)$$

Next, the case where normal grinding force per unit grinding width when the grindstone moves backward is made equal to that when the grindstone moves, forward is adopted by way of example in order to eliminate local machining with excessive load appearing in the related art when the grindstone moves backward. First, normal grinding forces $P_f$ and $P_h$ per unit grinding width when the grindstone moves forward and backward are respectively expressed by:

$$P_f=F_f/W_f=K_m\delta_f/W_f \quad (4)$$

$$P_b=F_b/W_b=K_m\delta_b/W_b \quad (5)$$

From the geometric dimensions, the grinding width $W_b$ when the grindstone moves backward is expressed by:

$$\begin{aligned} W_b &= (W_f - A')/\cos(\xi_f - \xi_b) \quad (6)\\ &= \frac{(W_r - A')\sqrt{(1+S_c^2K_m^2\delta_f^2)(1+S_c^2K_m^2\delta_b^2)}}{1+S_c^2K_m^2\delta_f\delta_b}\\ &\approx W_f - A' \end{aligned}$$

The trueing angle θ when the normal grinding force per unit grinding width when the grindstone moves forward is made equal to that when the grindstone moves backward can be obtained from the expressions (1), (4) and (5). That is, from $P_f=P_b$:

$$\delta_b=\delta_f(1-A'/W_f) \quad (7)$$

From the expression (2):

$$\sin\xi_f=S_cK_m\delta_f/\sqrt{(1+S_c^2K_m^2\delta f^2)} \quad (8)$$

In consideration of the expression (9), the expression (8) can be modified:

$$\sin\xi_f\approx S_cK_m\delta_f \quad (10)$$

Similarly, $$\sin\xi_b\approx S_cK_m\delta_b \quad (11)$$

If the expressions (7), (10) and (11) are substituted into the expression (1):

$$\begin{aligned} A\sin\theta &= \delta_f A'/W_f - \{(A'-L/2)+(L/2)(1-A'/W_f)\delta_f S_cK_m\} \quad (12)\\ &= (\delta_f A'/W_f)\{1-S_cK_m(W_f-L/2)\} \end{aligned}$$

Here, because A=A' can be set, and because the trueing angle θ with no load is small:

$$\tan\theta=\sin\theta/\sqrt{(1-\sin^2\theta)}\approx\sin\theta \quad (13)$$

From the expressions (12) and (13), the trueing angle θ can be finally expressed by:

$$\tan\theta=(F_f/W_f)\{1/K_m-S_c(W_f-L/2)\} \quad (14)$$

As shown in (14), the trueing angle θ when the normal grinding forces per unit grinding width are made equal to each other at the time of grindstone oscillation can be expressed by a function having normal grinding force $F_f$ at the forward end of the grindstone as a variable. Oscillation grinding is performed by the grindstone trued with the trueing angle θ obtained by detecting the normal grinding force. In case that the normal grinding force changes largely in skip grinding or the grindstone is changed, the angle θ is changed in accordance therewith.

Figure 3B:
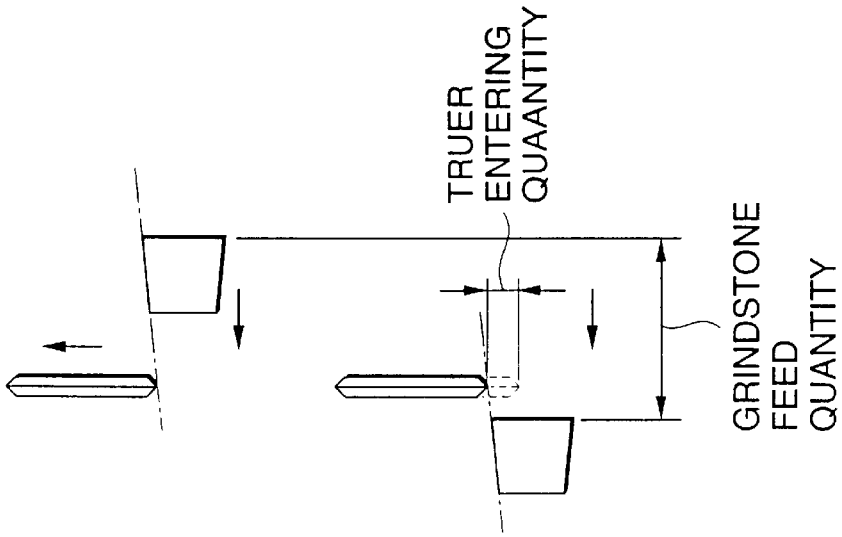
FIG. 3B is a view showing a state that the grindstone is trued.
Figure 3A:
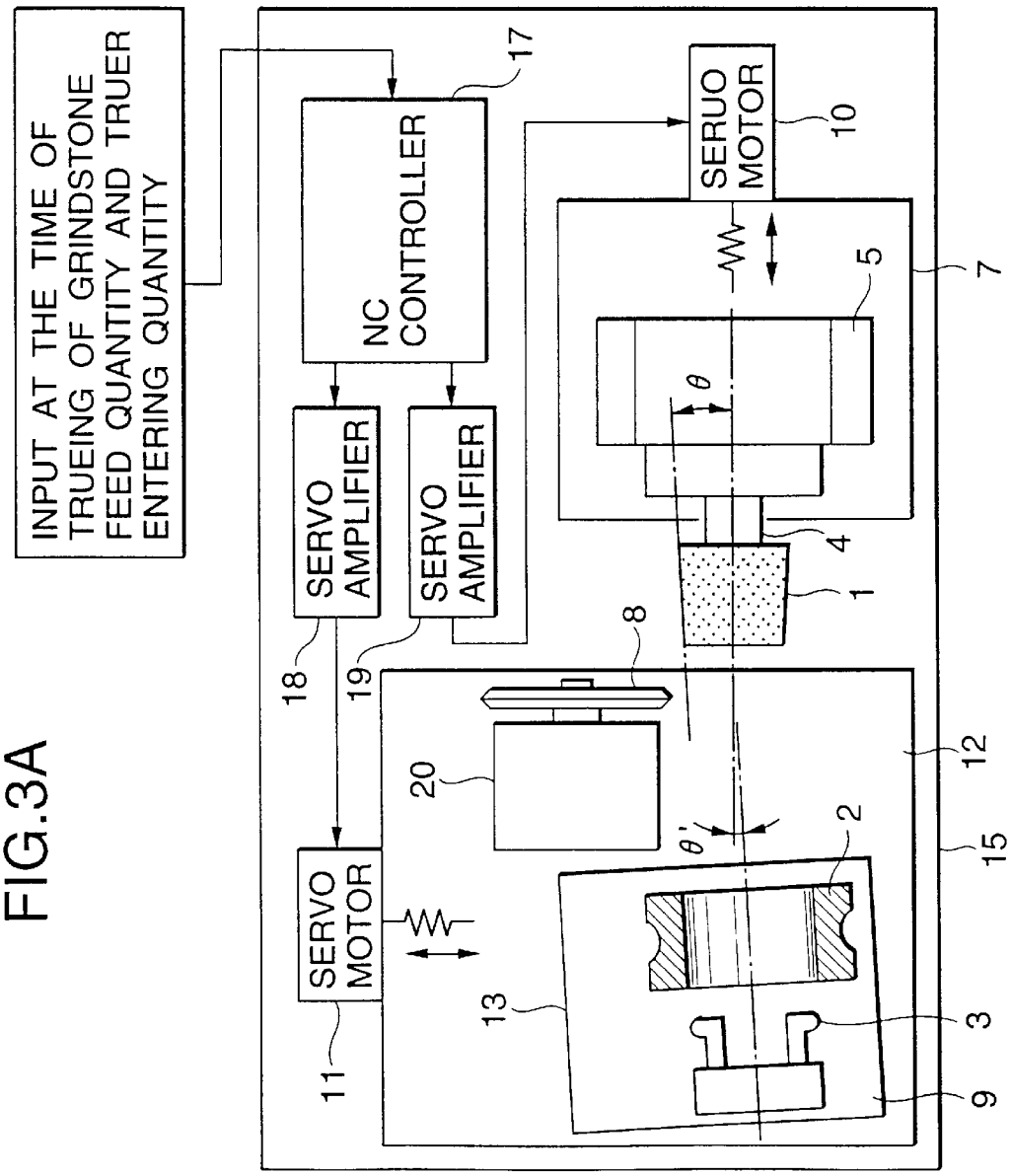
FIG. 3A is a schematic plane view of an internal grinding machine according to an embodiment of the present invention.

Next, a description will be given of a work internal grinding machine and its operation for carrying out the above-mentioned internal grinding method with reference to FIGS. 3A to 5. As shown in FIG. 3A, a X-axis slide table 7 and a wheel spindle device 5 having a same axis with the table 7 are mounted on a body bed 15, and a grindstone 1 is attached to the quill 4. A cross slide table 12 is mounted on the body bed 15 so as to be in opposition to the X-axis slide table 7 and so as to be movable in a direction perpendicular to the moving direction of the X-axis slide table 7. A work head-stock 13 holding a work 2 and an in-process size measuring device 9 is mounted on the cross slide table 12. An in-process size measuring gauge contact 3 of the in-process size measuring device 9 has access into the work 2 in parallel with-the axis of the work so as to measure the inner size of the work 2. The head-stock 13 can be tilted around a not-shown vertical pivot relative to the cross slide table 12.

On the cross slide table 12, a trueing device 20 is provided at the,rear of the X-axis. A disc-like truer 8 rotating at a high speed is supported on the trueing device 20. The truer 8 rotates in contact with the circumferential surface of the grindstone. At the same time, the grindstone 1 moves along its axis in accordance with the operation of the X-axis slide table 7 while rotating around the axis. Thus, the circumferential surface of the grindstone 1 is trued. Then, by driving of the servo motor 11, the cross slide table 12 moves perpendicularly to the X-axis slide table 7 as the grindstone 1 and the truer 8 are in contact with each other. In addition, by driving the servo motor 10, the X-axis slide table 7 also moves along the X-axis together with the grindstone 1. By such-synchronized control of the two tables 12 and 7, the circumferential surface of the grindstone 1 is trued to be inclined relative to its axis. Specifically, as shown in FIG. 3B, the cross slide table 12 moves backward from the start of trueing at the forward end of the grindstone, and the X-axis slide table 7 moves forward synchronizedly with the cross slide table 12, so that the truer 8 trues the grindstone from its forward end to its backward end. Thus, the grindstone 1 is trued into a tapered shape having a smaller diameter at its forward end as shown in FIG. 3B. The angle between the generatrix and the X-axis is a trueing angle θ. The trueing angle θ depends on the feed quantity in X-direction and the feed quantity of the truer. A controller 17 with an NC function and amplifiers 18 and 19 are provided for the concurrent control of the two servo motors 11 and 10. The feed quantity in X-direction and the feed quantity of the truer(for retreat at the time of trueing) are fed into the NC controller 17, which decides a set trueing angle θ.

The trueing angle θ is set along the expression (14) as described with reference to FIG. 1. The expression (14) is a function having normal grinding force $F_f$ as a variable. Therefore, A piezoelectric force transducer for detecting normal grinding force (in general, four piezoelectric force transducers) is put between the wheel spindle device 5 and the X-axis slide table 7. The normal grinding force applied to the grindstone 1 at the time of grinding operation is sum of the forces detected by the respective force transducers (the normal grinding force may be measured in advance).

Oscillation, grinding of the inner surface of the work 2 is performed with the grindstone 1 trued thus with the angle θ by the oscillating operation of the X-axis slide table 7. Then, the oscillation grinding is also based on intermittent in-process size measurement in cooperation with the in-process size measuring device 9. Here, the work 2 is supported to be inclined at an angle θ' to X-axis, specifically in a direction in which the inner surface of the work 2 and the circumferential surface of the grindstone are in linear contact with each other, so that desired cylindricity can be obtained in consideration of the generatrix direction on the grindstone surface when the grindstone moves most forward and the quill bending quantity at the time of grinding. The in-process size measuring device 9 supported on the head-stock 13 is also inclined at the same angle. This angle θ' is set to be larger than the trueing angle θ by the quill bending quantity. Then, when the normal grinding force changes largely, for example, when the grindstone is changed, the trueing angle θ may be changed in accordance therewith. It is not always necessary to measure the normal grinding force $F_f$. In addition, although the above-mentioned embodiment was configured so that the head-stock 13 holding the work 2 and the in-process size measuring device 9 rotated within a horizontal plane relative to the cross slide table 12 so that the work was inclined, the present invention is not limited to this configuration. For example, when the inner surface of the work 2 is ground at its upper or lower side, in accordance therewith the work 2 together with the in-process size measuring device 9 may be inclined at a proper, angle within a vertical plane including the axis of the wheel spindle device 5.

Figure 4:
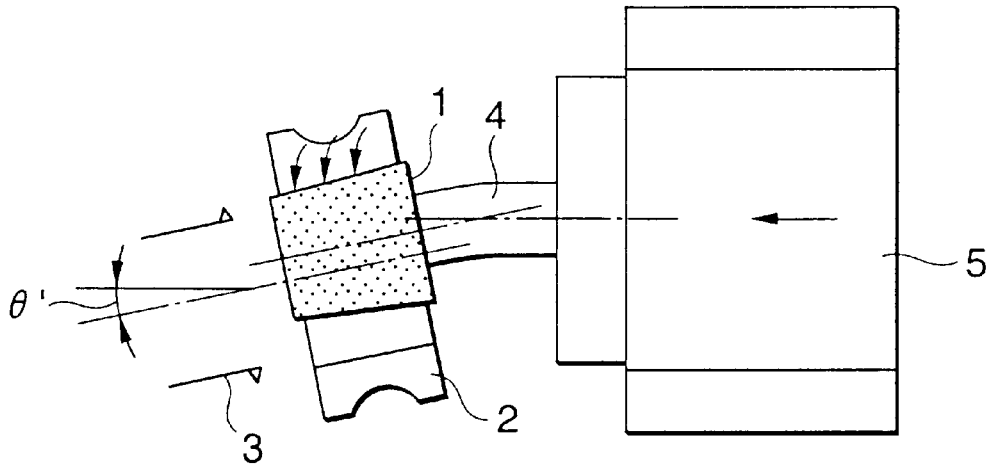
FIG. 4 is a sectional view showing a state at a forward end of grindstone oscillation in intermitten in-process target size measurement grinding.
Figure 5:
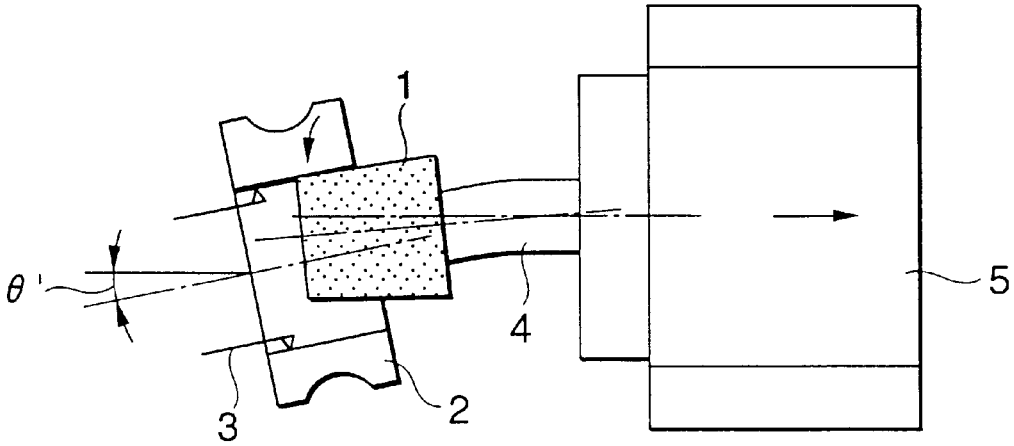
FIG. 5 is a sectional view showing a state at a backward end of grindstone oscillation in intermittent in-process target-size measurement grinding.
Figure 6:
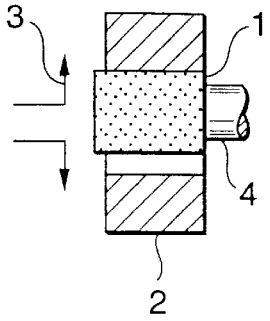
FIG.6 PRIOR ART
FIG. 6 is a sectional view showing a state at a forward end of grindstone oscillation in intermittent in-process target-size measurement grinding according to the related art.
Figure 7:
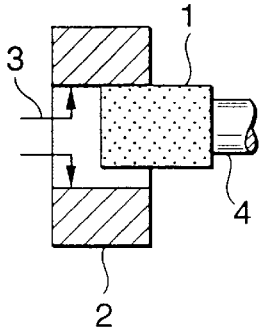
FIG.7 PRIOR ART
FIG. 7 is a sectional view showing a state at a backward end of grindstone oscillation in intermittent in-process target-size measurement grinding according to the related art.
Figure 8:
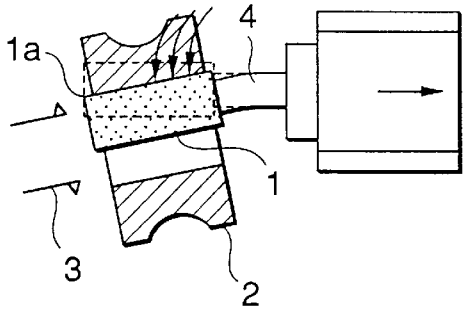
FIG.8 PRIOR ART
FIG. 8 is a sectional view showing a state at a forward end of grindstone oscillation in a bending state of a wheel spindle according to the related art.
Figure 9:
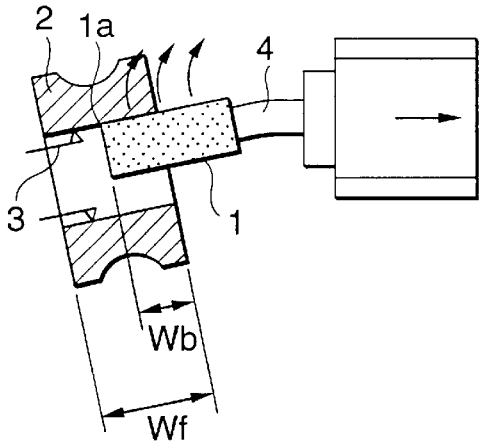
FIG.9 PRIOR ART
FIG. 9 is a sectional view showing a state at a backward end of grindstone oscillation in a bending state of a wheel spindle according to the related art.
Figure 12A:
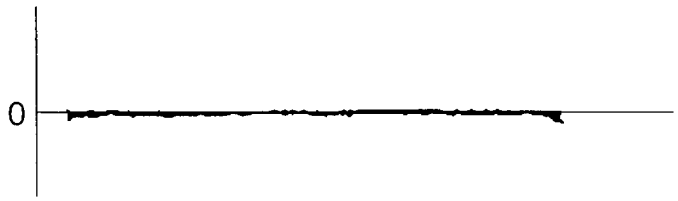
FIG.12A PRIOR ART
FIGS. 12A and 12B are views showing a generatrix-shape accuracy of an inner diameter of a work according to the related art.
Figure 12B:
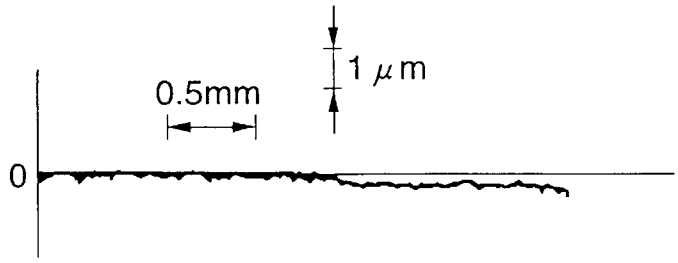
Figure 10:
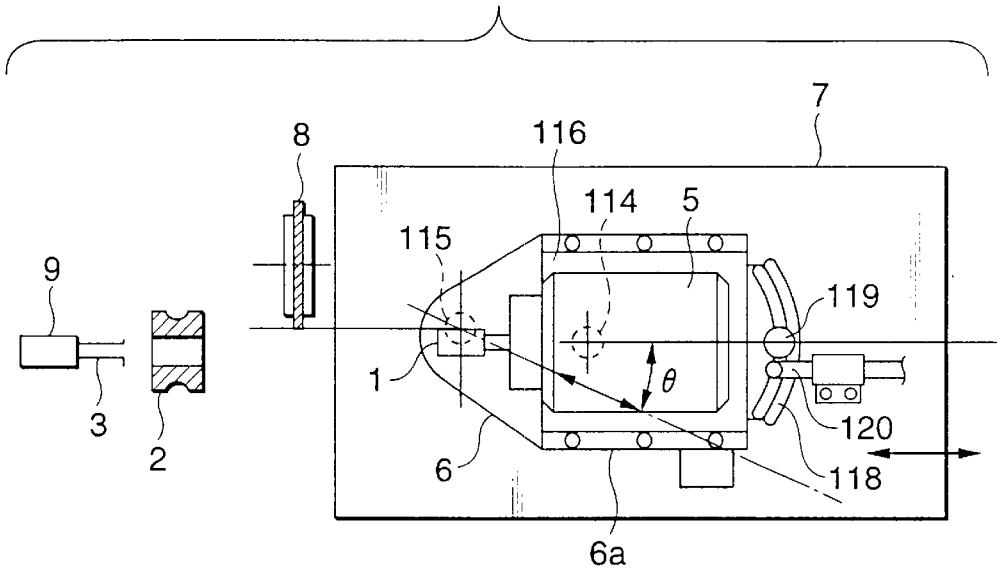
FIG.10 PRIOR ART
FIG. 10 is a partially plane view of a conventional internal grinding machine in which a grindstone is oscillated in the inclined direction.
Figure 11:
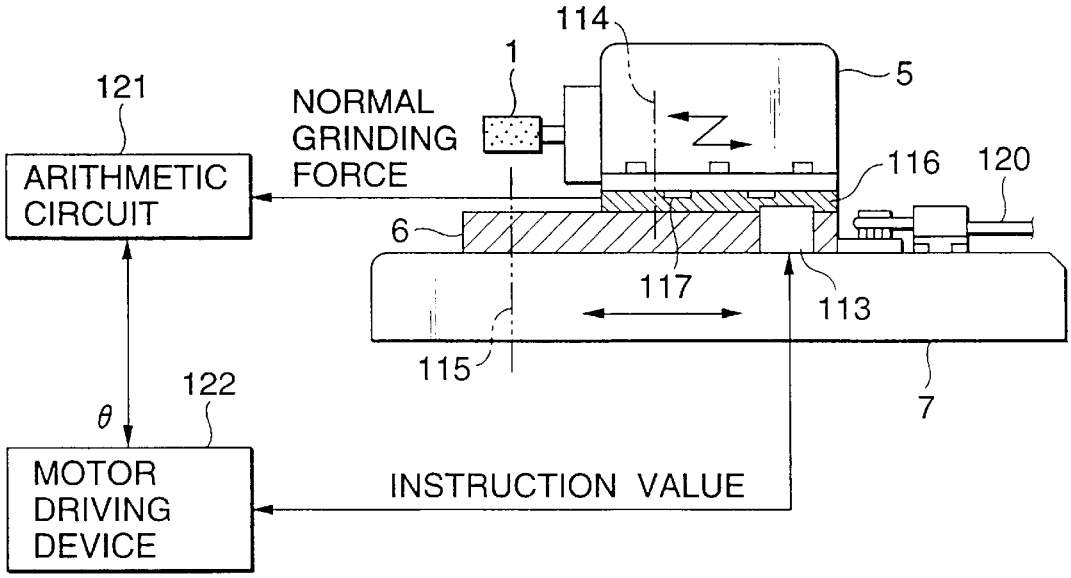
FIG.11 PRIOR ART
FIG. 11 is a schematic side view of a conventional internal grinding machine.

FIG. 4 is a view showing a relationship between the grindstone 1 and the work 2 when the grindstone moves most forward in oscillation grinding. FIG. 5 is a view showing a relationship between the grindstone 1 and the work 2 when the grindstone moves most backward. Since the work 2 is inclined at the angle θ', the inner surface of the work is ground in full-face contact with the circumferential surface of the grindstone 1 having inclined generatrix, as shown in FIG. 4, when the grindstone moves most forward. When the grindstone 1 moves backward at the time of oscillation, as shown in FIG. 5, the grindstone 1 is moved backward to separate from the work 2 by the inclined generatrix structure of the grindstone 1. Therefore, the bending quantity of the quill at this time is reduced, so that the normal grinding force is reduced. As a result, there is no fear of excessive machining force in a forward edge of the grindstone when the grindstone is retreated, which causes deterioration of the generatrix shape of the inner surface of the work as in the related art. Thus, a ground surface equivalent to that in FIG. 12A can be obtained. In addition, there is no fear that an excessive load is applied to the forward edge of the grindstone which makes the shape of the grindstone worse, thereby shortening the life of the grindstone.

As has been described above, according to the present invention, oscillation grinding is performed with a grindstone trued into a shape inclined in a direction so that the grindstone separates from a work when the grindstone moves backward in the oscillating operation of the grindstone. As a result, the bending quantity of the quill when the grindstone moves backward is reduced. It is therefore possible to prevent normal grinding force per unit grinding width from being excessive, so that the dimensional accuracy of the work is improved, and the life of the grindstone is prolonged. In a method in which a grindstone is oscillated in a direction inclined relative to the X-axis, an oscillation unit for such oscillation and a table mounted thereon are required in addition to a X-axis slide table, and a tilting/clamping operation of the grindstone oscillation unit, a reverse-rotating/clamping operation of the working table relative to the unit, and so on, are required. According to the present invention, however, the grindstone is trued so as to be inclined only by numerical control of a cross slide table on which the X-axis slide table and a trueing device are mounted. Thus, as for the grinding machine itself, a grinding machine already installed can be used only by simple alteration construction such as addition of a control device for tables, or the like. The operation of the grinding machine is also extremely easy. Thus, an internal grinding method having high reliability and an internal grinding machine having high-accuracy can be obtained.

While only certain embodiments of the invention have been specifically described herein, it will-apparent that numerous modifications may be made thereto without departing from the concept and scope of the invention.

What is claimed is:

1. An internal grinding method, comprising:

trueing a circumferential surface of a grindstone in a tapered shape, so that an attached end of said grindstone that is attached to a wheel spindle has a larger diameter portion than a free end of said grindstone, so as to define a trueing angle θ between a moving direction of an X-axis slide table and said circumferential surface thereof, said trueing angle θ being more than 0°;

grinding an inner surface of a work to have a straight line generatrix shape while performing an in-process inner-diameter size measurement intermittently through high-speed oscillation synchronized between said grindstone and an in-process gauge; and wherein said trueing angle θ is set so as to reduce a normal grinding force when said x-axis slide table moves in a backward direction, wherein the backward direction is a direction in which the grindstone is moved to be separated from the work and the in-process gauge is inserted in the work, wherein in said trueing step, said trueing angle θ of said grindstone is obtained by performing a synchronized control of a grindstone feed quantity for moving said X-axis slide table in an axial direction of said grindstone by use of a servo motor coupled with said X-axis slide table and a feed quantity of a truer by moving a cross slide table in a direction perpendicular to said axial direction of said grindstone by use of a servo motor coupled with said cross slide table, and said synchronized control is performed by a controller with an NC function.

2. An internal grinding method according to claim 1, wherein said trueing step is performed by a truer having a trueing surface having the same direction as a surface of said work to be ground.

3. An internal grinding method according to claim 2, wherein said trueing step is performed while moving said X-axis slide table in said x-axis direction.

4. An internal grinding method, comprising:

trueing a circumferential surface of a grindstone in a tapered shape so as to define a trueing angle θ between a moving direction of an X-axis slide table and said circumferential surface thereof, said trueing angle θ being more than 0°;

grinding an inner surface of a work to have a straight line generatrix shape while performing an in-process inner-diameter size measurement intermittently through high-speed oscillation synchronized between said grindstone and an in-process gauge; and wherein said trueing angle θ is set so as to reduce a normal grinding force when said x-axis slide table moves backward, wherein said work and an in-process measuring device are supported on a cross side table so that an axis of said inner surface of said work and an axis of said in-process measuring device rare inclined at an angle θ' with respect to an axial direction of said grindstone, and said angle θ' is made larger than said trueing angle θ of said grindstone, whereby the normal grinding force when said X-axis slide table moves backward is reduced, wherein in said trueing step, said trueing angle θ of said grindstone is obtained by performing a synchronized control of a grindstone feed quantity for moving said X-axis slide table in an axial direction of said grindstone by use of a servo motor coupled with said X-axis slide table and a feed quantity of a truer by moving a cross slide table in a direction perpendicular to said axial direction of said grindstone by use of a servo motor coupled with said cross slide table, and said synchronized control is performed by a controller with an NC function.

5. An internal grinding method according to claim 4, wherein said angle θ' of said axis of said inner surface of said work and said axis of said in-process measuring device with respect to said axial direction of said grindstone is set so that said inner surface of said work and said circumferential surface of said grindstone are in linear contact with each other, in consideration of a generatrix direction on said circumferential surface of said grindstone when said grindstone moves most forward, and a bending quantity of a quill at the time of grinding.

6. An internal grinding method according to claims 1, wherein said trueing angle θ of said grindstone is set to have a relation of the following expression:

$$\tan\theta=(Ff/Wf)\{1/Km-Sc(Wf-L/2)\}$$

wherein Ff is a normal grinding force, Wf is a grinding width, L is an axial length of the grindstone, Km is a mechanical bending rigidity in normal direction, and Sc is an inclination sensitivity of the grindstone surface relative to the normal grinding force of the grindstone surface.

7. An internal grinding machine, comprising:

a grindstone having a circumferential surface inclined in a tapered shape, so that an attached end of said grindstone that is attached to a wheel spindle has a larger diameter portion than a free end of said grindstone, with a trueing angle θ relative to an axis of said grindstone;

a X-axis slide table performing an oscillating operation along said axis of said grindstone;

a wheel spindle device held on said X-axis slide table, said X-axis slide table having said grindstone at an end thereof;

a cross slide table moving in a direction perpendicular to said direction of said axis of said grindstone;

a grindstone trueing device held on said cross slide table, for traverse trueing said circumferential surface of said grindstone;

a work supporting device held on said cross slide table, for supporting a work inclined relative to a moving direction of said X-axis slide table so that an inner surface of said work abuts against said circumferential surface of said grindstone an in-process size measuring device held on said work supporting device inclined together with said work; and a control device controlling a forward/backward motion of said X-axis slide table and a feed motion of said cross slide table so that said circumferential surface of said grindstone is trued with respect to said moving direction of said X-axis slide table, wherein said truing angle θ is set so as to reduce a normal grinding force when said X-axis slide table moves in a backward direction, wherein the backward direction is a direction in which the grindstone is moved to be separated from the work and the in-process measuring device is inserted in the work, wherein said trueing angle θ of said grindstone is obtained by performing a synchronized control of a grindstone feed quantity for moving said X-axis slide table in an axial direction of said grindstone by use of a servo motor coupled with said X-axis slide table and a feed quantity of a truer by moving a cross slide table in a direction perpendicular to said axial direction of said grindstone by use of a servo motor coupled with said cross slide table, and said synchronized control is performed by a controller with an NC function.

8. An internal grinding method according to claim 6, wherein in said trueing step, said trueing angle θ of said grindstone is obtained by performing a synchronized control of a grindstone feed quantity for moving said X-axis slide table in an axial direction of said grindstone by use of a servo motor coupled with said X-axis slide table and a feed quantity of a truer by moving a cross slide table in a direction perpendicular to said axial direction of said grindstone by use of a servo motor coupled with said cross slide table, and said synchronized control is performed by a controller with an NC function.

9. An internal grinding machine, comprising:

a grindstone having a circumferential surface inclined in a tapered shape with a trueing angle θ relative to an axis of said grindstone;

a X-axis slid table performing oscillating operation along said axis of said grindstone;

a wheel spindle device held on said x-axis slide table, said X-axis slide table having said grindstone at an end thereof;

a cross slide table moving in a direction perpendicular to said direction of said axis of said grindstone;

a grindstone trueing device held on said cross slide table, for traverse trueing said circumferential surface of said grindstone;

a work supporting device held on said cross slide table, for supporting a work inclined relative to a moving direction of said X-axis slide table so that an inner surface of said work abuts against said circumferential surface of said grindstone an in-process size measuring device held on said work supporting device inclined together with said work; and a control device controlling a forward/backward motion of said X-axis slide table and a feed motion of said cross slide table so that said circumferential surface of said grindstone is trued with respect to said moving direction of said X-axis slide table, wherein said truing angle θ is set so as to reduce a normal grinding force when said X-axis slide table moves backward, wherein said work supporting device is supported on said cross slide table so that an axis of said inner surface of said work and an axis of said in-process measuring device are inclined at an angle θ' with respect to said direction of said axis of said grindstone, and said angle θ' is larger than said truing angle θ of said grindstone, wherein said trueing angle θ of said grindstone is obtained by performing a synchronized control of a grindstone feed quantity for moving said X-axis slide table in an axial direction of said grindstone by use of a servo motor coupled with said X-axis slide table and a feed quantity of a truer by moving a cross slide table in a direction perpendicular to said axial direction of said grindstone by use of a servo motor coupled with said cross slide table, and said synchronized control is performed by a controller with an NC function.

10. An internal grinding machine according to claim 7, wherein said grindstone trueing device is disposed so that a trueing surface thereof is in the same direction as a surface of the work to be ground.

11. An internal grinding machine according to claim 10, further comprising a servo motor performing a synchronized control of said X-axis slide table and said cross slide table so that said trueing angle θ of said grindstone has a predetermined angle.

12. An internal grinding method according to claim 11, wherein said predetermined angle is set to have a relation of the following expression:

$$\tan\theta=(Ff/Wf)\{1/Km-Sc(Wf-L/2)\}$$

wherein Ff is a normal grinding force, Wf is a grinding width, L is an axial length of the grindstone, Km is a mechanical bending rigidity in normal direction, and Sc is an inclination sensitivity of the grindstone surface relative to the normal grinding force of the grindstone surface.

* * * * *